United States Patent [19]

Williams et al.

[11] 4,363,706

[45] Dec. 14, 1982

[54] ANODE

[75] Inventors: David E. Williams, Abingdon; Kamal K. Verma, Birmingham; John M. Fisher, Tamworth, all of England

[73] Assignee: IMI Kynoch Limited, Birmingham, England

[21] Appl. No.: 238,023

[22] Filed: Feb. 25, 1981

[30] Foreign Application Priority Data

Mar. 7, 1980 [GB] United Kingdom ..... 8007789

[51] Int. Cl.[3] ..... C25C 1/08; C25B 11/04

[52] U.S. Cl. ..... 204/105 R; 204/112; 204/293

[58] Field of Search ..... 204/105 R, 112, 291–293

[56] References Cited

U.S. PATENT DOCUMENTS 4,080,278 3/1978 Ravier et al. ..... 204/293

*Primary Examiner*—R. L. Andrews

*Attorney, Agent, or Firm*—Cushman, Darby & Cushman

[57] ABSTRACT

A titanium-nickel alloy containing 51 to 55.4% nickel with the addition of optional quantities of niobium intended for use as an anode in the electrowinning of metal, particularly cobalt, an electrolytic cell incorporating such an anode and a method of operating such a cell.

14 Claims, 1 Drawing Figure

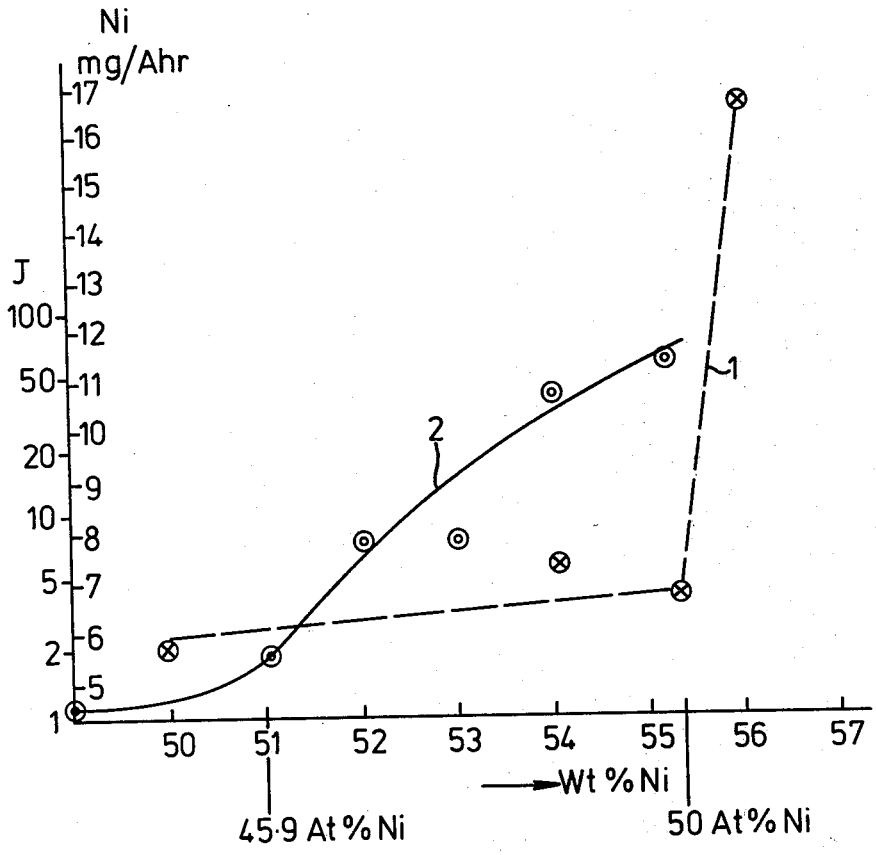
Ni
mg/Ahr
J
100
50
20
10
5
2
1
17
16
15
14
13
12
11
10
9
8
7
6
5
1
2
50
51
52
53
54
55
56
57
Wt % Ni
45·9 At % Ni
50 At % Ni

ANODE

BACKGROUND OF THE INVENTION

This invention relates to alloys and has particular reference to alloys of titanium and nickel intended for use as anodes in electrowinning cells and has further reference to methods of operating electrowinning cells incorporating such anodes.

The present invention is concerned with the provision of alloys of titanium and nickel which are suitable as anodes for electrometallurgical applications. In the electrowinning of metals a solution, normally an aqueous solution containing ions of the metal to be won, is treated in an electrowinning bath or vat to extract metal from the solution. Alternating anodes and cathodes are positioned in the solution in the bath and an electrical current is passed between them. The metal is normally deposited onto the cathode and oxygen is evolved at the anode. The anode has to be able to withstand the aggressive conditions resulting from the evolution of oxygen at the surface of the material. There have been many materials used in practice over the past one hundred years. The principal materials for the anodes have comprised lead or lead alloys such as lead-silver or lead-calcium and complex silicides such as Luilu, which is a cobalt silicide, or Chilex, which is a copper silicide.

With the development of precious metal-containing anodes for the electrochemical industry attempts have been made to use anodes formed of titanium having a precious metal or precious metal oxide coating. To date these anodes have not been of any significant commercial use, the main reason being that they have too high a capital cost in relation to their life. It has been proposed to use a semiconsumable material such as is described in U.S. Pat. No. 3,957,600. That U.S. patent describes the use of alloys of a film-forming metal together with one or more elements of Atomic Nos. 23 to 29 as anodes in the electrowinning of metal from an aqueous solution. The present invention is concerned with the use of materials of the type generally described in U.S. Pat. No. 3,957,600. The present invention is a selection of certain limited ranges of materials which have been found to have unique mechanical strength and low wear rates.

SUMMARY OF THE INVENTION

By the present invention there is provided an electrode for an electrowinning cell in which the anodically active material is formed of an alloy of titanium and nickel, the nickel content being in the region of 51 to 55 wt% of the sum of the titanium and nickel contents. The present invention further provides a method of operating an anode containing titanium and nickel, the nickel content being in the region of 51 to 55 wt% of the sum of the titanium and nickel contents, which comprises the steps of inserting the anode and a cathode into a solution and operating the anode preferably under conditions such that the surface remains substantially free of passive scale during operation. The surface may be kept substantially scale-free by cleaning.

The anode may comprise an alloy consisting essentially of titanium and nickel, the nickel being present in an amount of 51 to 55% by weight of the alloy. In the alternative, the anode may comprise an alloy including titanium and nickel wherein the nickel is present in an amount of 46 to 50 atomic percent of the alloy. The anode may include tantalum or niobium present in an amount between 0.1 and 5 atomic percent, preferably 2% tantalum or less.

Preferably the oxygen content is maintained below 10,000 parts per million (ppm), further preferably below 6,000 ppm. Reducing the oxygen content to 3,000 ppm or lower leads to further improvements in the wear rate of the material.

The oxygen content may be maintained at a suitably low level by melting the alloy under an inert gas atmosphere or in a vacuum. Alternatively the oxygen content may be lowered by the use of a de-oxidiser. A suitable de-oxidiser may be calcium. Alternatively, magnesium, lithium or mischmetal may be used either singly or in combination as a de-oxidiser. The de-oxidiser may be added in an amount of up to 3% by weight of the liquid metal, although the majority of the de-oxidiser, if not all of it, is slagged off.

The alloy may be homogenised by heat treatment. The heat treatment may take place at a temperature in the range 400° C. to 1,000° C. for a time in the range one hour to 168 hours. The material may be heat treated at a temperature in the range 750° C. to 950° C. for a time in the range 8 to 24 hours.

The material may contain 0.01 to 0.25% of a metal chosen from the group platinum, iridium, ruthenium, rhodium and palladium. The metal may be palladium present in an amount in the region 0.05 to 0.2%.

BRIEF DESCRIPTION OF THE DRAWING

By way of example the present invention will now be described with reference to the accompanying drawing, which is a graph showing corrosion rate and Charpy impact values against percent nickel and titanium.

DESCRIPTION OF THE PREFERRED EMBODIMENT

In order that anodes can be used in commercial electrowinning operations—such as in the electrowinning of cobalt from cobalt-containing solutions—it is necessary that they be sufficiently tough to withstand the everyday knocks which they will encounter in use. Toughness is a combination of lack of brittleness together with sufficient inherent strength to survive the loadings which the material will normally encounter. It has now been discovered that the toughness of titanium-nickel alloys varies significantly when the nickel content of the alloy is varied in the range 45 to 51 atomic percent (corresponding to 50 to 56 wt% nickel). It has also been discovered that the corrosion rate for alloys containing more than 50 atomic percent nickel increases dramatically, probably as a result of the formation of $TiNi_3$ intermetallic compounds. Titanium-nickel alloys are suitable for use as oxygen-evolving anodes in the electrowinning of cobalt. As is well-known, an electrowinning cell comprises a series of alternating anodes and cathodes immersed in an electrolyte containing cobalt ions. The principal reaction at the cathode is the deposition of cobalt metal and the principal reaction at the anode is the evolution of oxygen.

As mentioned above, conventional anodes for cobalt electrowinning cells have been formed of lead or lead alloys such as lead-antimony. The disadvantages of lead anodes are that they wear gradually, that they are not very strong, and also that the lead released contaminates the cobalt electrodeposit. Although, as mentioned above, it has already been proposed to use titanium-nickel alloys as anodes in electrowinning, the present invention is based on the discovery that within a small region of generally known compositions anodes can be produced which are both corrosion-resistant and also tough so as to withstand the shocks involved in travelling and handling in the plant.

Referring now to the drawing, this shows a combined graph of corrosion wear rate against percent nickel and also Charpy values in joules against percent nickel. Referring first to the corrosion rate, this is illustrated by means of the x's in circles which are connected by the broken line 1. It can be seen that the rate of loss of nickel from the anode is relatively constant until approximately 50 atomic percent nickel is present in the titanium-nickel alloy. In the constant region the loss is between 6 and 7 mg/Ah when tested under the following conditions.

In sulphuric acid (150 $gl^{-1}$);
at room temperature (18° to 22° C.); and at
a current density of 600 $Am^{-2}$.

When larger percentages of nickel are present there is a dramatic increase to approximately 16 to 17 mg/Ah. It is believed that this is caused by the presence of the intermetallic compound $TiNi_3$, which corrodes more rapidly than the mixture of titanium compounds TiNi and $Ti_2Ni$ formed at lower nickel contents. Thus, from a corrosion point of view the maximum nickel content should not exceed 50 atomic percent.

Considering, however, the Charpy impact values these are shown on a logarithmic scale by means of the dots in the circles which are connected by a solid line 2. It can be seen that the material containing less than 46 atomic percent nickel has a very low Charpy impact value of below 2 joules. There is, however, a rapidly increasing toughness above 46 atomic percent which improves with increasing nickel content. At 48 atomic percent nickel the Charpy value is something of the order of twenty times greater, ie the material is some twenty times tougher than 45 atomic percent nickel alloys. It can be seen, therefore, that within the very small region of 46 to 50 atomic percent nickel, and even more so between 48 and 50 atomic percent nickel (allowing for normal variation in manufacture), the material has a very low wear rate while being of high toughness. Outside the very small range of the invention the material has a high wear rate at nickel contents in excess of 50 atomic percent or is very brittle at nickel contents below 46 atomic percent.

It has been proposed, see, for example, British Patent Specification No. 1,463,553, that intermetallic electrodes of the type of the present invention should have formed on their surface an oxide coating. The mechanism of operation of anodes of the type including the present invention is not yet clear. It is observed, however, that the anodes tend to form a scale which includes oxides of the base metals and that this scale appears to play no part in the evolution of oxygen when the anodes are in use. It has further been observed that should the anode happen to operate at conditions where no corrosion product scale is formed the wear rate dramatically falls below those experienced where a scale is formed. It now appears that the presence of the scale encourages local highly acid regions beneath the scale which causes local corrosion of the anode. The local corrosion can be vastly in excess of that experienced by the anode in the bulk solution. It appears that the scale is based on the formation of complex titanium oxides which are deposited onto the surface of the anode when the rate of formation of titanium ions by dissolution of titanium from the anode is greater than that which can be accommodated in a soluble form in the electrolyte adjacent to the anode surface. It has now been discovered that once it is possible to operate anodes at a sufficiently low wear rate such that passive scale does not form on the anode, the unwanted local dissolution of the anode does not take place and the overall wear rate as measured in mg/Ah falls dramatically. It appears, therefore, that there is a criticality in terms of the wear rate of titanium and nickel containing anodes insofar as once the wear rate has fallen below a certain critical level the tendency to form a passive scale on its surface stops, thus reducing acid undermining and this in turn prevents the formation of further scale leading to further undermining etc.

It has further been found that there are a number of ways of reducing wear rate below this critical level—which seems to be of the order of 5 mg/Ah for the nickel, ie 10 mg/Ah for the alloy as a whole. One method is to maintain the oxygen content of the alloy at a very low level. This can be by ensuring that the materials from which the alloy is made are low in oxygen and casting the material under a vacuum. Alternatively, the alloy may be cast under an argon blanket and may be de-oxidised by a suitable de-oxidant such as mischmetal. It is not yet certain why low oxygen is desirable but it appears that the oxygen is present in the alloy as a complex oxide $Ti_4Ni_2O$ and this means that small quantities of oxygen consume large quantities of titanium, eg 1.5% of oxygen leads to the formation of 30 wt% $Ti_4Ni_2O$ in the material of the anode. Because such large quantities of titanium are used in the oxide the remainder of the material becomes enriched in nickel. For example in an alloy containing nominally 53% by weight nickel the presence of 1.5% oxygen leads to a remaining alloy containing 59 wt% nickel 41 wt% titanium.

Even at low oxygen contents there is a danger of local nickel-rich regions, which are highly corrodable, being formed on the surface of oxide crystals. One method of overcoming this is to homogenise the material by heat treating it at a temperature of 900° C. for 24 hours so that the nickel is distributed uniformly throughout the alloy and no highly corrodable regions are formed.

A further method of increasing the corrosion resistance of the material is to add small quantities of tantalum or niobium in amounts up to 5 atomic percent where the oxygen level is kept low, preferably below 6,000 ppm and further preferably below 3,000 ppm. It has been observed that this reduces the wear rate below the critical level.

Further, the critical level may be reached by the addition of palladium to the titanium-nickel alloy. It has again been observed that 0.1% palladium leads to wear rates of about 10 mg/Ah. It is thought that the palladium in some way segregates to the grain boundaries and reduces locally the corrosion of the material in that area.

The results of experiments carried out to measure the wear rate of various materials in 75 g/l $H_2SO_4$ at 70° C. at a current density of 300 $A/m^2$ are given in Table I.

TABLE I

| | Ti wt % | Ni wt % | O ppm | Pd wt % | Ta wt % | Nb wt % | Wear rate mg/Ah of the alloy |
|---|---|---|---|---|---|---|---|
| 1 | 47.00 | 53.00 | 6 000 | — | — | — | 20 |

TABLE I-continued

| | Ti wt % | Ni wt % | O ppm | Pd wt % | Ta wt % | Nb wt % | Wear rate mg/Ah of the alloy |
|---|---|---|---|---|---|---|---|
| 2 | 47.00 | 53.00 | 1 000 | — | — | — | 14 |
| 3 | 47.00 | 52.90 | 8 000 | 0.1 | — | — | 18 (as cast) |
| 4 | 47.00 | 52.90 | 8 000 | 0.1 | — | — | 10 (heat treated 16 hours at 800° C. |
| 5 | 43.15 | 53.05 | 5 000 | | | 3.30 | 12 |
| 6 | 41.70 | 51.28 | 7 000 | | 6.32 | | 8 |
| 7 | 41.00 | 50.42 | 2 600 | | | 8.32 | 8 |
| 8 | 41.00 | 52.50 | 1 000 | | 6.45 | | 6 |
| 9 | 41.00 | 52.50 | 7 000 | | 6.45 | | 10 |
| 10 | 42.30 | 54.20 | 1 000 | | | 3.42 | 7.5 |
| 11 | 42.30 | 54.20 | 7 000 | | | 3.42 | 20 |

It has also been found that small additions of iron, up to 10 atomic percent, or copper, up to 10 atomic percent, or cobalt, up to 10 atomic percent, have a beneficial effect on wear rate and particularly on crevice corrosion. In the case of anodes for cobalt winning copper would not be desirable above 0.5 atomic percent because of the deleterious effect of copper in metallic cobalt deposited on the cathode.

In addition to tantalum or niobium beneficial additions may comprise other metals which form solid solutions with the anode material and which have a maximum valency of 5 or more, such as tungsten. These may be present in amounts of up to 5 atomic percent.

We claim:

1. An electrode for an electrowinning cell for electrolysis of an acid medium in which the anodically active material is formed of an alloy of titanium and nickel, the nickel content being in the region of 51 to 55 wt% of the sum of the titanium and nickel contents.

2. An electrode as claimed in claim 1 in which the oxygen content is below 10,000 parts per million.

3. An electrode as claimed in claim 2 in which the oxygen content is below 6,000 parts per million.

4. An electrode as claimed in claim 3 in which the oxygen content is below 3,000 parts per million.

5. A method of electrowinning a metal from an electrowinning cell containing an aqueous solution of ions of that metal which comprises inserting an anode and a cathode into the solution the anode being formed of an alloy of titanium and nickel, the nickel content being in the region of 51 to 55 wt% of the sum of the titanium and nickel contents, and passing an electrical current between the anode and the cathode.

6. A method as claimed in claim 5 in which the anode is operated under conditions such that the surface remains substantially free of passive scale during operation.

7. A method of electrowinning as claimed in claim 6 in which the electrode is cleaned to maintain the surface substantially free of passive scale.

8. An electrode for an electrowinning cell for electrolysis of an acid medium in which the anodically active material is formed of an alloy of titanium and nickel, the nickel content being in the region of 51 to 55 wt% of the sum of the titanium and nickel contents, and tantalum or niobium in an amount between 0.1 and 5 atomic percent.

9. An electrode as in claim 8 in which there is less than 2 atomic percent tantalum or niobium.

10. An electrode as claimed in claim 8 in which there is further provided 0.01 to 0.25% of a metal chosen from the group platinum, iridium, ruthenium, rhodium and palladium.

11. An electrode as claimed in claim 8 in which palladium is present in the range 0.05 to 0.2% by weight.

12. An electrode as claimed in claim 8 in which the oxygen content is below 10,000 parts per million.

13. An electrode for an electrowinning cell for electrolysis of an acid medium in which the anodically active material is formed of an alloy of titanium and nickel, the nickel content being in the region of 51 to 55 wt% of the sum of the titanium and nickel contents, and 0.01 to 0.25 wt% of a metal chosen from the group consisting of platinum, iridium, ruthenium, rhodium and palladium.

14. An electrode as in claim 13 in which palladium is present in the range 0.05 to 0.2 wt percent.

* * * * *